US008800954B2

(12) United States Patent
Edwards

(10) Patent No.: US 8,800,954 B2
(45) Date of Patent: Aug. 12, 2014

(54) BLOW OUT PREVENTERS

(75) Inventor: Jeffrey Charles Edwards, Aberdeen (GB)

(73) Assignee: Enovate Systems Limited, Aberdeen (GB)

( * ) Notice: Subject to any disclaimer, the term of this patent is extended or adjusted under 35 U.S.C. 154(b) by 1384 days.

(21) Appl. No.: 11/665,088

(22) PCT Filed: Oct. 17, 2005

(86) PCT No.: PCT/GB2005/003993

§ 371 (c)(1),
(2), (4) Date: Oct. 28, 2008

(87) PCT Pub. No.: WO2006/040590

PCT Pub. Date: Apr. 20, 2006

(65) Prior Publication Data

US 2009/0050828 A1 Feb. 26, 2009

(30) Foreign Application Priority Data

Oct. 16, 2004 (GB) ..... 0423016.5

(51) Int. Cl.
*E21B 33/06* (2006.01)

(52) U.S. Cl.
USPC ..... 251/1.3; 251/175; 277/324

(58) Field of Classification Search
CPC ..... E21B 33/062
USPC ..... 251/1.3, 1.1, 170, 172, 175; 277/324, 277/327, 342, 648; 166/85.4
See application file for complete search history.

(56) References Cited

U.S. PATENT DOCUMENTS

| | | | | | |
|---|---|---|---|---|---|
| 1,861,614 | A | * | 6/1932 | Schweitzer | 277/325 |
| 3,023,994 | A | | 3/1962 | Gibson et al. | |
| 3,102,709 | A | * | 9/1963 | Allen | 251/1.3 |
| 3,191,619 | A | * | 6/1965 | Allen | 137/527.4 |
| 3,561,526 | A | * | 2/1971 | Williams et al. | 166/55 |
| 3,633,926 | A | * | 1/1972 | Hryniszak et al. | 277/404 |
| 3,744,749 | A | * | 7/1973 | Le Rouax | 251/1.3 |
| 3,817,326 | A | * | 6/1974 | Meynier, III | 166/55 |
| 4,132,267 | A | * | 1/1979 | Jones | 166/55 |
| 4,227,543 | A | * | 10/1980 | Williams, Jr. | 137/246.22 |
| 4,236,692 | A | * | 12/1980 | Williamson | 251/328 |

(Continued)

FOREIGN PATENT DOCUMENTS

GB 2352494 A 1/2001

*Primary Examiner* — John K Fristoe, Jr.
*Assistant Examiner* — David Colon Morales
(74) *Attorney, Agent, or Firm* — Tarolli, Sundheim, Covell & Tummino LLP

(57) ABSTRACT

A blow out preventer (10) includes a housing (40) defining a longitudinal throughbore (16) and a ram cavity (34) and at least one pair of opposed rams (12, 14) located in the ram cavity. Each ram includes a seal (18, 24) disposed on an upper surface (20, 26) and the rams are movable transversely across the bore. The blow out preventer further includes at least one seal seat (30) having a seal surface (36) for engaging with the ram seals. There is a seal seat associated with each at least one pair of rams, the seal seat being moveably mounted in the ram cavity. In one embodiment the seal seat continuously engages the rams as the rams move from a cavity open position to a cavity closed position.

24 Claims, 4 Drawing Sheets

(56) References Cited

U.S. PATENT DOCUMENTS

| | | | | | |
|---|---|---|---|---|---|
| 4,240,503 | A * | 12/1980 | Holt et al. | 166/55 |
| 4,347,898 | A * | 9/1982 | Jones | 166/55 |
| 4,444,404 | A | 4/1984 | Parks, Jr. | |
| 4,690,411 | A * | 9/1987 | Van Winkle | 277/325 |
| 5,294,088 | A * | 3/1994 | McWhorter et al. | 251/1.3 |
| 6,719,042 | B2 * | 4/2004 | Johnson et al. | 166/55 |
| 6,719,262 | B2 * | 4/2004 | Whitby et al. | 251/1.3 |
| 2004/0084644 | A1 * | 5/2004 | Wiedemann | 251/1.3 |

* cited by examiner

BLOW OUT PREVENTERS

FIELD OF THE INVENTION

The present invention relates to blow out preventers and particularly to the sealing of blow out preventers.

BACKGROUND OF THE INVENTION

Blow our preventers (BOPs) are well known safety apparatus for sealing off oil or gas wells during emergency situations so as to contain potentially dangerous blow-outs.

Several different types of BOP are known in the art. One of these is the ram-type BOP, which typically includes a housing having a throughbore for providing access to the well, and at least one pair of rams mounted in the housing, the rams of each pair being located on opposite sides of the throughbore. In the event of an emergency opposing rams move into, and close, the throughbore, thereby sealing off the well.

Sealing the throughbore is assisted by the provision of elastomer seal elements incorporated in the ram body. The first of these seal elements is disposed on the upward facing surface of the rams, for engaging with a seal surface machined into the ram cavity, and the second element is disposed on the inward facing vertical surface of the ram. These seal elements are positioned such that when the rams are moved to the closed condition, and the inward facing vertical surfaces are in contact, a continuous elastomer seal is formed between the ram bodies and their cavities and also between the contacting faces of the rams.

When the rams are in the closed condition and the pressure below the rams is higher than the pressure above, the rams are forced to move upwards towards the upper surface of the ram cavity. This is beneficial to sealing in two ways: firstly, the seals are pressed progressively harder against the cavity, and secondly the extrusion gap is reduced.

However, conventional BOPs have a disadvantage in that if the pressure above the rams is greater than the pressure below, these two benefits do not occur. Indeed, in such a case, the rams float downwards, away from the cavity sealing surface, simultaneously unloading the seal and increasing the extrusion gap.

This behaviour is one reason which explains why ram-type BOPs are not reliable for containing pressures from above.

Additionally, conventional BOPs are of limited use on high pressure gas wells, because, due to the space constraints within the BOP housing, it is very difficult to machine a seal seat surface in the ram cavity which is smooth enough to allow a high integrity seal to be made between the upper surface of the rams and the seal seat. This problem is accentuated if, during the closing of the rams, the elastomeric seal element on the upper surface of the rams is damaged by being dragged across the ram cavity surface.

SUMMARY OF THE INVENTION

It is an object of the present invention to obviate or mitigate at least one of the aforementioned disadvantages.

According to a first aspect of the present invention there is provided a blow out preventer including:

a housing defining a longitudinal throughbore and a ram cavity;

at least one pair of opposed rams located within the ram cavity, each ram including a seal disposed on an upper surface of the ram, the at least one pair of rams being movable from a first position wherein the throughbore is open to a second position wherein the throughbore is closed, and at least one seal seat arranged in the ram cavity, a seal seat being associated with each pair of rams, the at least one seal seat having a seal surface for continuously engaging with the ram seals as the at least one pair of rams moves from the first position to the second position.

By incorporating a separate seal seat, the seal surface can be prepared so that the ram seals will not be damaged as the at least one pair of rams moves from the first position to the second position.

Preferably the seal seat is moveably mounted in the ram cavity. By moveably mounting the seal seat in the ram cavity, the seal seat can move towards the ram seals if the pressure on the upper surface of the at least one pair of rams is greater than the pressure on an opposing surface of the at least one pair of rams.

Preferably the seal seat has been hard faced. Hard facing is a method of adding a coating of a metal or alloy to a component and produces a surface of exceptional resistance to scratching and degradation.

Preferably the elongate seal seat has been ground. Grinding produces a surface of exceptional flatness and smoothness. Providing a seal seat that has been both hard faced and ground minimises the degradation which occurs in the seal during movement of the at least one pair of rams from the first position to the second position which enhances the sealing capabilities of the blow out preventer.

Preferably, the opposed rams include complementary interlocking profiles to stabilise the rams when the rams are in the second position.

According to a second aspect of the present invention there is provided a blow out preventer including:

a housing defining a longitudinal throughbore and a ram cavity;

at least one pair of opposed rams located in the ram cavity, each ram including a seal disposed on an upper surface, the rams being movable transversely across the bore, and at least one seal seat having a seal surface for engaging with the ram seals, a seal seat being associated with each at least one pair of rams, the seal seat being moveably mounted in the ram cavity.

Providing a moveably mounted seal seat permits the seal seat to move towards the ram seals if the pressure on the upper surface of the at least one pair of rams is greater than the pressure on an opposing surface of the at least one pair of rams, thereby enhancing the seal between the seal seat and the at least one pair of rams. This provides an arrangement wherein the BOP ram assembly provides bi-directional pressure containment.

Preferably the at least one seal seat has a seal surface which continuously engages rams seal throughout the movement of the at least one pair of rams.

Preferably the seal seat has been hard faced. Hard facing produces a surface of exceptional resistance to scratching and degradation.

Preferably the seal seat has been ground. Grinding produces a surface of exceptional flatness and smoothness. Providing a seal seat that has been both hard faced and ground minimises the degradation which occurs in the seal during translation of the ram which enhances the sealing capabilities of the blow out preventer.

Preferably, the opposed rams include complementary interlocking profiles to stabilise the rams when the rams are in the throughbore closed position.

The seal seat may include a protruding seal engaging element adapted to engage the seal when the rams are in the throughbore closed position. When the rams are in the throughbore closed position, the presence of a protruding seal engaging element will squeeze the seal and improve the integrity of the seal formed. The protruding element may have a semi-circular cross section.

According to a third aspect of the present invention there is provided a method of maintaining seal integrity of a seal disposed on at least one blow out preventer ram as said at least one ram travels across a throughbore of the blow out preventer, said method comprising the steps of:

moving the at least one ram from a throughbore open position to a throughbore closed position; and continuously engaging the seal with a seal seat throughout the movement of the at least one ram between the throughbore open and throughbore closed positions.

According to a fourth aspect of the present invention there is provided a method of sealing a blow out preventer having a throughbore and at least one pair of rams, the rams closing said throughbore when the pressure above the at least one pair of rams is grater than the pressure below at least one pair of rams, said method comprising the step of:

applying a pressure to a moveable seal seat sufficient to move the movable seal seat towards, and form a contact seal with, the at least one pair of closed rams.

According to a fifth aspect of the present invention there is provided a seal seat for use in a blow out preventer.

According to a sixth aspect of the present invention there is provided a moveable seal seat for use in a blow out preventer.

By virtue of the present invention, a throughbore in a blow out preventer may be sealed with a high integrity seal which can withstand pressure from both above and below the seal.

BRIEF DESCRIPTION OF THE DRAWINGS

These and other aspects of the present invention will now be described by way of example only with reference to the accompanying drawings in which.

DESCRIPTION OF EXAMPLE EMBODIMENTS

Figure 1:
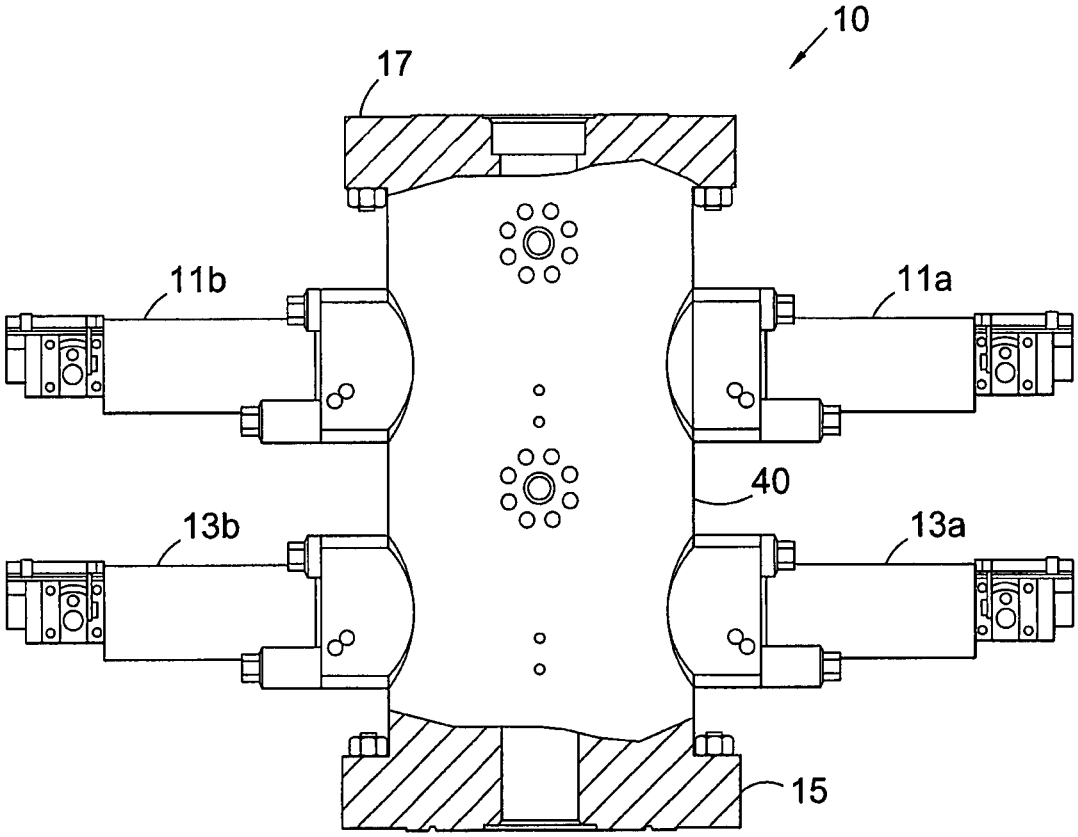
FIG. 1 shows a side view of a blow out preventer with multiple pairs of rams according to an embodiment of the present invention.

Referring firstly to FIG. 1 there is shown a side view of a blow out preventer (BOP), generally indicated by reference numeral 10, with multiple pairs of rams according to an embodiment of the present invention. The BOP 10 comprises a housing 40 defining a first pair of ram houses 11*a*, 11*b* and a second pair of ram houses 13*a*, 13*b*.

The lower end 15 of the BOP 10 is adapted to be connected, for example, to a Christmas tree through a connector, and the upper end 17 is adapted to be connected, for example, to a lubricator or riser.

Figure 2:
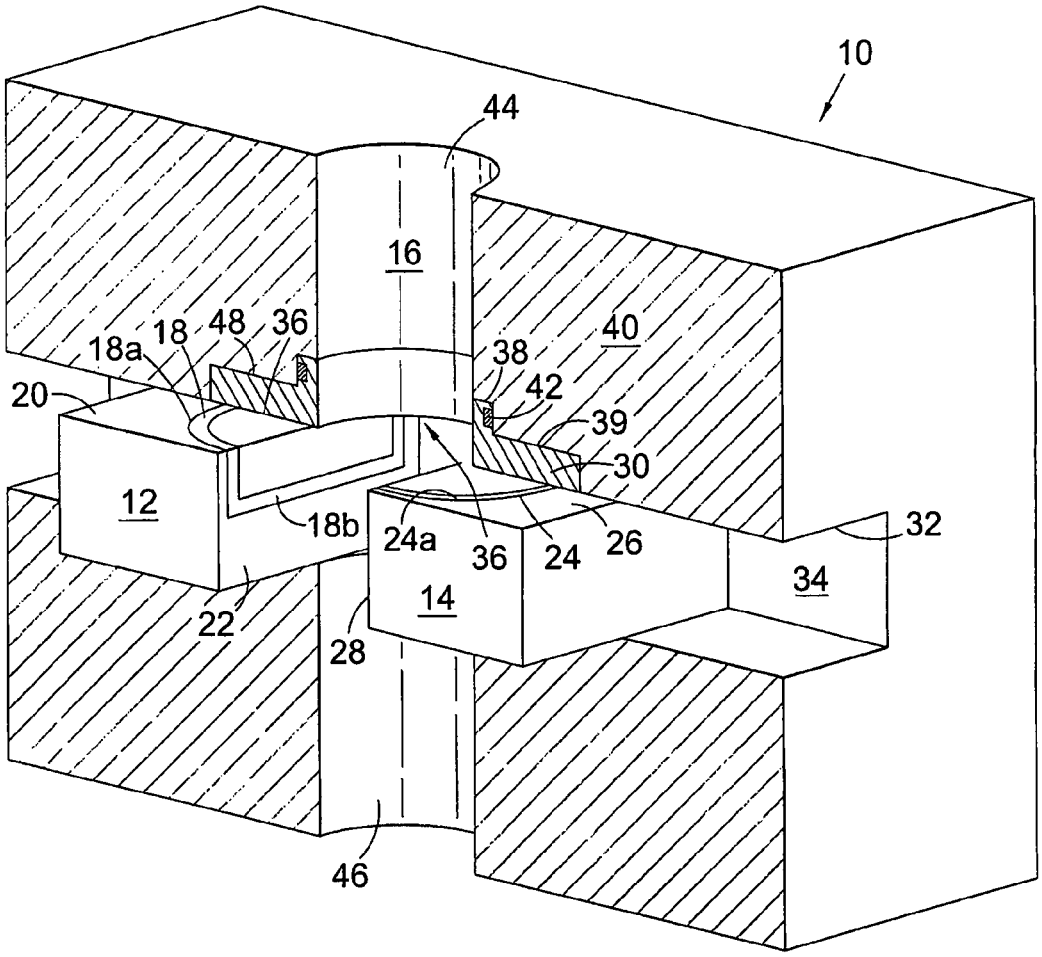
FIG. 2 is a cut-away perspective view of part of the blow out preventer of FIG. 1 in an open configuration.

FIG. 2 shows a cut-away perspective view of part of the blow out preventer 10 of FIG. 1 in an open configuration. The housing 40 defines a BOP throughbore 16 and a ram cavity 34. The BOP 10 also includes a pair of rams 12,14 shown in an open configuration such that the rams 12,14 do not obstruct the BOP throughbore 16.

The first ram 12 includes an elastomeric seal 18 comprising a first portion 18*a* which is disposed on the top surface 20 of the first ram 12 and a second portion 18*b* which is disposed on the front surface 22 of the first ram 12. Similarly the second ram 14 includes an elastomeric seal 24 with a first portion 24*a* disposed on the top surface 26 of the second ram 14 and a second portion 24*b* (not shown) disposed on the front surface 28 of the second ram 14. The second portions 18*b*,24*b* of both the first and second seals 18,24 are arranged opposed to each other so that when the rams 12,14 are in a closed configuration (as shown in FIG. 2) the second seal portions 18*b*,24*b* engage with each other to form a seal, shown in broken outline, between the front surfaces 22,28. The first 18*a* and second portion 18*b* of the first seal 18 are connected to form a continuous seal. Similarly, the first 24*a* and second portion 24*b* of the second seal 24 are connected to form a continuous seal The BOP 10 includes a seal seat 30 mounted within the top surface 32 of the ram cavity 34. The seal surface 36 is wide enough such that when the rams 12,14 are in the open configuration, as shown in FIG. 1, the seal surface 36 engages the first elastomeric seal portions 18*a*,24*a* of the seals 18,24.

Figure 4:
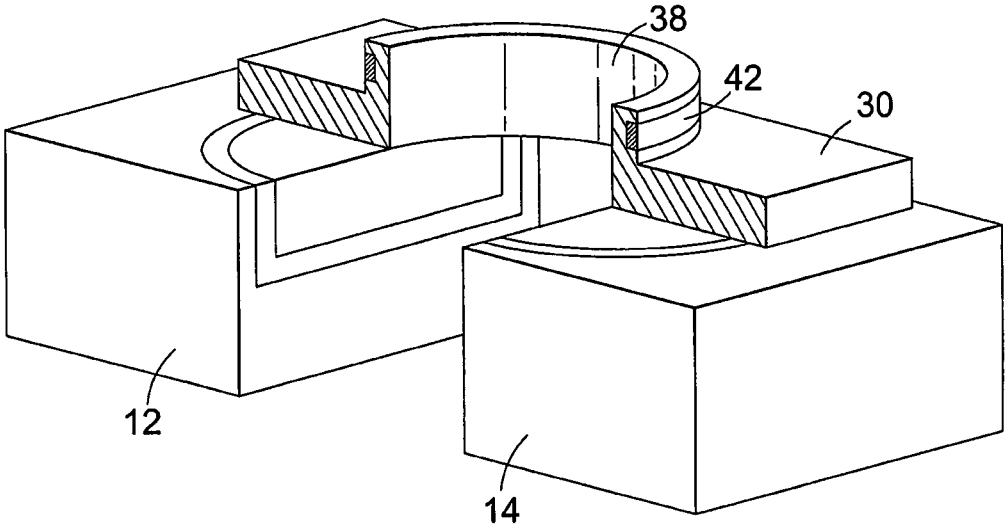
FIG. 4 shows a perspective view of the seal seat and rams of the blow out preventer of FIGS. 1, 2 and 3.

The elongate seal seat 30 includes a collar 38, which is upstanding from the top surface 39 of the seal seat 30. Mounted around the outside of the collar 38 is an O-ring seal 42 which is best seen in FIG. 4. The O-ring seal 42 prevents leakage of pressurised fluid which may be present along the interface 48 between the BOP housing 40 and the seal seat 30.

The elongate seal seat 30 is moveably mounted within the BOP housing 40 the purpose of which is discussed in connection with FIG. 3.

Figure 3:
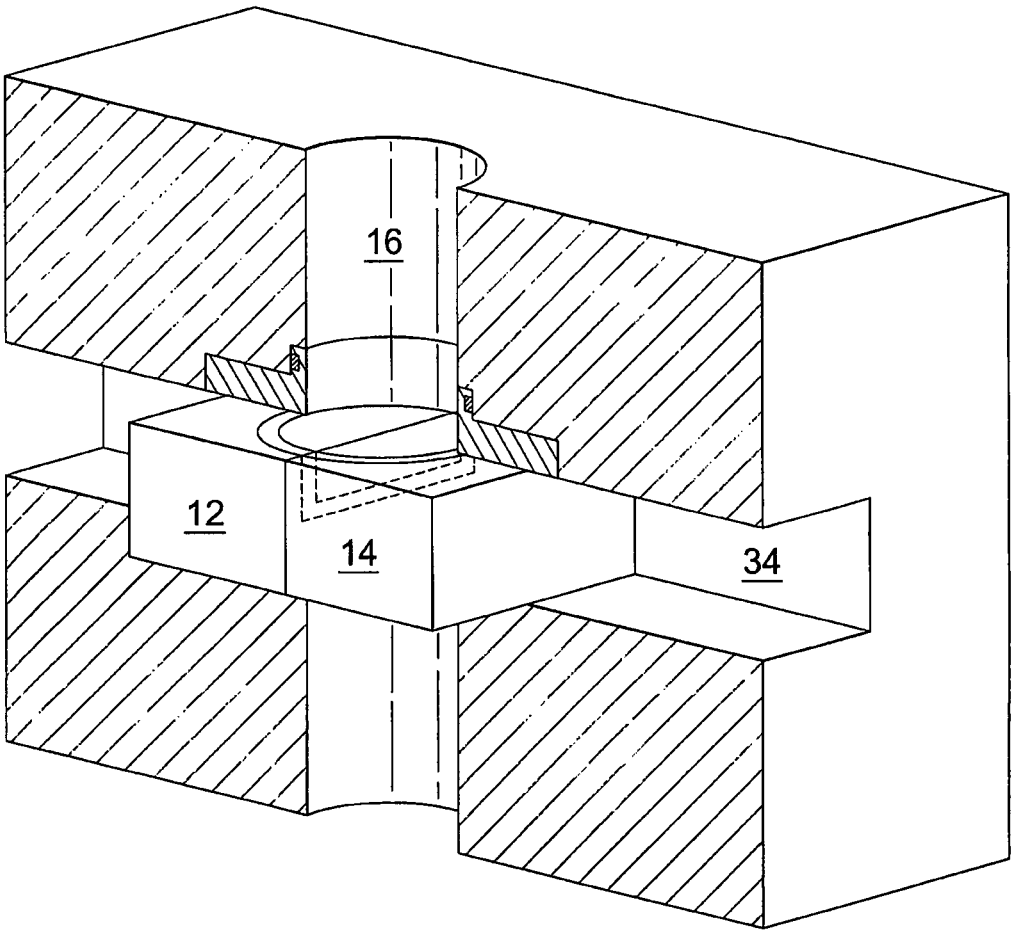
FIG. 3 shows the blow out preventer of FIG. 2 with the rams in a closed configuration.

Referring now to FIG. 3, the rams 12,14 have moved the same distance across the ram cavity 34 to seal the throughbore 16. As the first seal portions 18*a*,24*a* are engaged with the seal surface 36 and the second seal portions 18*b*,24*b* are engaged with each other, the throughbore 16 is now sealed.

In this configuration, if the pressure in an upper end 44 of the throughbore is greater than the pressure in a lower end 46 of the throughbore 16, then the seal seat 30 is moved towards the rams 12,14 ensuring the seal integrity is maintained. The presence of the O-ring seal 42 prevents leakage and loss of pressure through the interface 48 between the BOP housing 40 and the seal seat 30.

Various modifications and improvements may be made to the embodiments hereinbefore described without departing from the scope of the invention. For example a the opposed rams may include complementary interlocking profiles to stabilise the rams when the rams are in closed configuration.

Those of skill in the art will also recognise that the above-described embodiment of the invention provides a blow out preventer 10 incorporating a moveable seal seat 30, which maintains a high integrity seal in the closed configuration.

The invention claimed is:

1. A blow out preventer including:

a housing defining a longitudinal throughbore and a ram cavity;

at least one pair of opposed rams located in the ram cavity, each ram including a seal disposed on an upper surface, the rams being movable transversely across the bore in a first direction, and at least one seal seat having a seal surface for engaging with the ram seals, the at least one seal seat being associated with each at least one pair of rams, each seal seat being mounted in the ram cavity and being configured to move towards the ram seals in a second direction perpendicular to the first direction solely responsive to fluid pressure on the upper surface of the at least one pair of rams being greater than fluid pressure on an opposing surface of the at least one pair of rams, the at least one seal seat being mounted within a top surface of the ram cavity.

2. The blow out preventer of claim 1, wherein the at least one seal seat has a seal surface which continuously engages the ram seals throughout the movement of the at least one pair of rams.

3. The blow out preventer of claim 1, wherein the seal seat has been hard faced.

4. The blow out preventer of claim 1, wherein the seal seat has been ground.

5. The blow out preventer of claim 1, wherein the opposed rams include complementary interlocking profiles to stabilise the rams when the rams are in the throughbore closed position.

6. The blow out preventer of claim 1, wherein the seal seat includes a protruding seal engaging element adapted to engage the seal when the rams are in the throughbore closed position.

7. The blow out preventer of claim 6, wherein the protruding element has a semi-circular cross section.

8. The blow out preventer of claim 1, wherein the at least one pair of rams are configured to move transversely across the bore from a first condition in which the rams are spaced from one another to a second condition in which the rams engage each other so as to completely obstruct the throughbore.

9. The blow out preventer of claim 8, wherein a front surface on each ram of the at least one pair of rams exclusively engage each other when the rams are in the second condition.

10. The blow out preventer of claim 9, wherein the front surface of a first ram of a chosen one of the at least one pair of rams exclusively engages a front surface of a corresponding second ram of the chosen one of the at least one pair of rams with no other structure interposed transversely therebetween.

11. A blow out preventer including:

a housing defining a longitudinal throughbore and a ram cavity;

at least one pair of opposed rams located within the ram cavity, each ram including a seal disposed on an upper surface of the ram, the at least one pair of rams being movable in a first direction from a first position wherein the throughbore is open to a second position wherein the throughbore is closed, and at least one seal seat arranged in the ram cavity and associated with each pair of rams, the at least one seal seat having a seal surface for continuously engaging with the ram seals as the at least one pair of rams moves from the first position to the second position, each seal seat being mounted in the ram cavity and being configured to move towards the ram seals in a second direction perpendicular to the first direction solely responsive to fluid pressure on the upper surface of the at least one pair of rams being greater than fluid pressure on an opposing surface of the at least one pair of rams, the at least one seal seat being mounted within a top surface of the ram cavity.

12. The blow out preventer of claim 11, wherein the seal seat has been hard faced.

13. The blow out preventer of claim 11, wherein the elongate seal seat has been ground.

14. The blow out preventer of claim 11, wherein the opposed rams include complementary interlocking profiles to stabilise the rams when the rams are in the second position.

15. The blow out preventer of claim 11, wherein the at least one pair of rams are configured to move transversely across the bore from a first condition in which the rams are spaced from one another to a second condition in which the rams engage each other so as to completely obstruct the throughbore.

16. The blow out preventer of claim 15, wherein a front surface on each ram of the at least one pair of rams exclusively engage each other when the rams are in the second condition.

17. The blow out preventer of claim 16, wherein the front surface of a first ram of a chosen one of the at least one pair of rams exclusively engages a front surface of a corresponding second ram of the chosen one of the at least one pair of rams with no other structure interposed transversely therebetween.

18. A method of sealing a blow out preventer having a housing that defines a ram cavity, a throughbore and at least one pair of rams located within the ram cavity, the rams closing said throughbore in a first direction when the pressure above the at least one pair of rams is greater than the pressure below at least one pair of rams, said method comprising the step of:

applying a pressure to a moveable seal seat sufficient to move the movable seal seat towards, and form a contact seal with, the at least one pair of closed rams, the seal seat being mounted in the ram cavity and being configured to move towards the ram seals in a second direction perpendicular to the first direction solely responsive to fluid pressure on the upper surface of the at least one pair of rams being greater than fluid pressure on an opposing surface of the at least one pair of rams, the seal seat being mounted within a top surface of the ram cavity.

19. The method of claim 18, wherein the step of the rams closing said throughbore in a first direction when the pressure above the at least one pair of rams is greater than the pressure below at least one pair of rams includes:

exclusively engaging a front surface of a first ram of a chosen one of the at least one pair of rams with a front surface of a corresponding second ram of the chosen one of the at least one pair of rams with no other structure interposed transversely therebetween.

20. A method of maintaining seal integrity of a seal disposed on at least one pair of opposed rams of a blow out preventer as said at least one pair of rams travels across a throughbore of the blow out preventer, said blow out preventer including a housing defining the throughbore and a ram cavity, said at least one pair of rams being located in the ram cavity, said method comprising the steps of:

moving the at least one pair of rams in a first direction from a throughbore open position to a throughbore closed position; and continuously engaging the seal with a seal seat throughout the movement of the at least one pair of rams between the throughbore open and throughbore closed positions, the seal being mounted within the ram cavity and being configured to move towards the ram seals in a second direction perpendicular to the first direction solely responsive to fluid pressure on the upper surface of the at least one pair of rams being greater than fluid pressure on an opposing surface of the at least one pair of rams, the seal seat being mounted within a top surface of the ram cavity.

21. The method of claim 20, wherein the step of moving the at least one pair of rams from a throughbore open position to a throughbore closed position includes the step of:

moving the at least one pair of rams from a throughbore open position, in which the rams are spaced from one another, to a throughbore closed position, in which the rams engage each other so as to completely obstruct the throughbore.

22. The method of claim 21, wherein the step of moving the at least one pair of rams from a throughbore open position, in which the rams are spaced from one another, to a throughbore closed position, in which the rams engage each other so as to completely obstruct the throughbore, includes:

engaging a front surface on each ram of the at least one pair of rams exclusively with the front surface of the other ram to place the rams in the second condition.

23. The method of claim 22, wherein the step of engaging a front surface on each ram of the at least one pair of rams exclusively with the front surface of the other ram to place the rams in the second condition includes:

exclusively engaging the front surface of a first ram of a chosen one of the at least one pair of rams with a front surface of a corresponding second ram of the chosen one of the at least one pair of rams with no other structure interposed transversely therebetween.

24. A blow out preventer including:

a housing defining a longitudinal throughbore and a ram cavity;

at least one pair of opposed rams located in the ram cavity, each ram including a seal disposed on an upper surface, the rams being movable transversely across the bore in a first direction, and at least one seal seat having a seal surface for engaging with the ram seals, the at least one seal seat being associated with each at least one pair of rams, each seal seat being mounted in the ram cavity and being configured to move towards the ram seals in a second direction perpendicular to the first direction if pressure on the upper surface of the at least one pair of rams is greater than pressure on an opposing surface of the at least one pair of rams, the at least one seal seat being mounted within a top surface of the ram cavity, wherein the at least one seal seat has a seal surface which continuously engages the ram seals throughout the movement of the at least one pair of rams.

* * * * *